US008726809B2

(12) United States Patent
Walton et al.

(10) Patent No.: US 8,726,809 B2
(45) Date of Patent: May 20, 2014

(54) METHOD AND APPARATUS FOR PERFORATING

(75) Inventors: Ian C. Walton, Sugar Land, TX (US); Brenden M. Grove, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1111 days.

(21) Appl. No.: 11/426,802

(22) Filed: Jun. 27, 2006

(65) Prior Publication Data

US 2007/0295235 A1 Dec. 27, 2007

(51) Int. Cl.
*F42B 1/02* (2006.01)

(52) U.S. Cl.
USPC ..... 102/307; 102/306; 299/13

(58) Field of Classification Search
USPC ..... 102/306–310, 322, 475–476; 299/13
See application file for complete search history.

(56) References Cited

U.S. PATENT DOCUMENTS

| | | | | |
|---|---|---|---|---|
| 3,865,436 | A * | 2/1975 | Dorrough et al. | 299/13 |
| 4,239,286 | A * | 12/1980 | Coursen | 299/4 |
| 4,938,143 | A * | 7/1990 | Thomas et al. | 102/318 |
| 5,090,324 | A * | 2/1992 | Bocker et al. | 102/307 |
| 5,351,622 | A * | 10/1994 | Ekholm | 102/476 |
| 5,792,977 | A * | 8/1998 | Chawla | 102/307 |
| 5,859,383 | A * | 1/1999 | Davison et al. | 102/307 |
| 6,223,656 | B1 * | 5/2001 | Glenn | 102/306 |
| 6,460,463 | B1 * | 10/2002 | Parrott et al. | 102/312 |
| 6,523,474 | B2 * | 2/2003 | Parrott et al. | 102/312 |
| 6,588,344 | B2 * | 7/2003 | Clark et al. | 102/307 |
| 6,684,791 | B1 * | 2/2004 | Barnhart | 102/307 |
| 7,044,225 | B2 * | 5/2006 | Haney et al. | 166/308.1 |
| 7,219,734 | B2 * | 5/2007 | Bai et al. | 166/302 |
| 2003/0037692 | A1 | 2/2003 | Liu | |
| 2003/0131749 | A1 | 7/2003 | Lussier | |
| 2004/0144541 | A1 * | 7/2004 | Picha et al. | 166/302 |
| 2004/0154492 | A1 * | 8/2004 | Barnhart | 102/475 |
| 2005/0056459 | A1 * | 3/2005 | Haney et al. | 175/4.6 |
| 2005/0217853 | A1 * | 10/2005 | Hayes et al. | 166/297 |
| 2005/0217854 | A1 * | 10/2005 | Hayes et al. | 166/297 |
| 2006/0118303 | A1 | 6/2006 | Schultz et al. | |
| 2007/0044672 | A1 * | 3/2007 | Smith | 102/201 |
| 2007/0295235 | A1 * | 12/2007 | Walton et al. | 102/307 |

FOREIGN PATENT DOCUMENTS

| | | |
|---|---|---|
| RU | 2120028 C1 | 10/1998 |
| RU | 2194151 C2 | 12/2000 |
| RU | 2175058 C2 | 10/2001 |

(Continued)

OTHER PUBLICATIONS

Kozlovskij, E.A., et al., Mining Encyclopedia, vol. 2, Moscow, "Soviet Encyclopedia," Publishing House, 1986, 5 pages total. English translation provided.

(Continued)

*Primary Examiner* — D. Troy
(74) *Attorney, Agent, or Firm* — Jeffery R. Peterson; Brandon S. Clark

(57) ABSTRACT

A perforating system is disclosed having a perforating gun containing a plurality of radially-oriented shaped charges disposed along the longitudinal axis of the gun. Each charge, when detonated, produce a jet whose penetration velocity exceeds the acoustic velocity of the formation (i.e., target) material to be perforated. A method of operating such a perforating system is also provided, as is a shaped charge having the described characteristics.

2 Claims, 8 Drawing Sheets

(56) References Cited

FOREIGN PATENT DOCUMENTS

| | | | |
|---|---|---|---|
| RU | 34718 | U1 | 12/2003 |
| RU | 2253831 | C2 | 6/2005 |
| RU | 2270335 | C2 | 2/2006 |
| RU | 2281386 | C2 | 8/2006 |
| WO | WO/03/071219 | * | 8/2003 |

OTHER PUBLICATIONS

Drukovan, M.F., "Reference Book on Blast-Hole Drilling," Moscow, Nedra Publishing House, 1976, 6 pages total. English translation provided.

* cited by examiner

METHOD AND APPARATUS FOR PERFORATING

BACKGROUND OF THE INVENTION

1. Field of the Invention

The present invention relates to method and apparatus for performing perforating operations, and, more particularly, to performing such operations in a material which is naturally fractured or which has a low tensile strength.

2. Description of the Prior Art

For purposes of enhancing production from a subterranean formation, a perforating gun typically is lowered down into a wellbore that extends through the formation. A perforating gun comprises a plurality of radially-oriented shaped charges which are detonated to form perforations in the formation proximate the wellbore. The shaped charges typically are placed at points along a helical spiral that extends around a longitudinal axis of the perforating gun.

It is known that charge penetration into the hydrocarbon-bearing formation is a major determinant of well productivity. Extensive investigations have previously been conducted to characterize penetration, mainly into sandstone formations. Recent charge penetration experiments into coal have revealed surprising results that may be associated with the complex cleat or natural fracture system apparent in many kinds of coal. It is believed that these fractures in coal may adversely affect charge penetration performance. Specifically, such detriment may be due to shock passage through these fractures ahead of the jet. Such effects are expected to primarily occur when penetration velocity is subsonic with respect to the prevailing acoustic velocity of coal; i.e., during later stages of penetration when incoming jet velocity is lowest.

Classical hydrodynamic theory has since the 1940's been applied to the analysis shaped charge penetration. When a jet (of density $\rho_j$), traveling at velocity V penetrates a target having a density $\rho_t$, the jet-target interface will advance at a penetration velocity U. Penetration velocity is always some fraction of the incoming jet velocity; specifically:

$$U/(V-U)=\mathrm{sqrt}(\rho_j/\rho_t)$$

The magnitude of U, relative to the prevailing local acoustic velocity ($C_0$) of the target material, determines whether the penetration is sub- or super-sonic. If $U<C_0$, the penetration is said to be subsonic, and the shock wave formed by the penetration event will separate from the interface and advance ahead into the target. This separated wave can alter the state of the target into which subsequent jet portions enter.

Even for jet penetration which is slightly supersonic, the shock wave may detach due to shock velocity exceeding the acoustic velocity. Furthermore, an attached shock will tend to separate from the incoming jet, if the jet itself is decelerating (as is the case with real shaped charge jets).

SUMMARY OF THE INVENTION

In accordance with the present invention, a charge is provided for a perforating gun. Such a charge, when detonated, produces a jet having a penetration velocity that will always exceed the acoustic velocity of the target material to be perforated. In one embodiment, a charge in accordance with the present invention is fabricated for use with a target material which is a naturally fractured material, e.g., coal. In another embodiment, a charge in accordance with the present invention is fabricated for use in perforating a target material which has a low tensile strength.

In accordance with the present invention, a perforating gun system is provided for use in perforating the formation material proximate a wellbore, and such a perforating gun system comprises at least one perforating gun section. Each perforating gun section in the system comprises a plurality of radially-oriented shaped charges, which, when detonated, produce jets that have penetration velocities which will always exceed the acoustic velocity of the formation material proximate the wellbore. A system in accordance with the present invention further comprises a firing head to cause said shaped charges to detonate.

In one embodiment of a perforating gun system in accordance with the present invention, each charge may for use in perforating a formation material which a naturally fractured material, e.g., coal. In yet another embodiment of a perforating gun system in accordance with the present invention, each shaped charge is for use in perforating a formation material which has a low tensile strength.

In accordance with the present invention, a method is also provided of operating a perforating gun containing a plurality of shaped charges to perforate the formation material proximate a wellbore. Such a method comprises lowering the perforating gun into the wellbore and detonating the plurality of shaped charges. A method in accordance with the present invention further comprises producing jets from said shaped charges where the jets have penetration velocities that exceed the acoustic velocity of the formation material proximate the wellbore. In one embodiment of the present invention, jets are produced which have penetration velocities that exceed the acoustic velocity of coal, while in another embodiment of the present invention, the jets from the shaped charges produce penetration velocities that exceed the acoustic velocity of material which has a low tensile strength.

DESCRIPTION OF THE SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention practiced without those details and that numerous variations from and modifications of the described embodiments may be possible. The following description is thus intended to illustrate and not limit the present invention.

Figure 1:
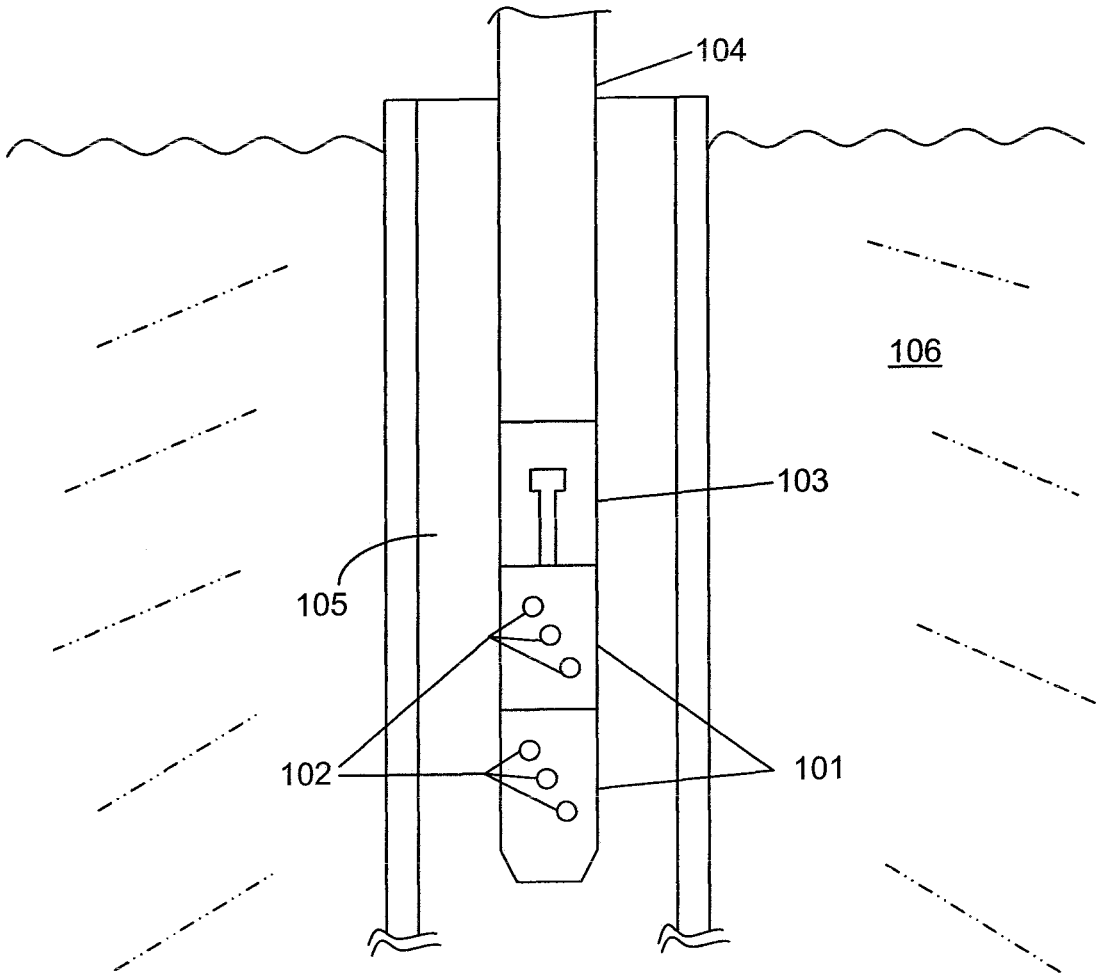
FIG. 1 is a pictorial drawing illustrating a perforating gun system.

Referring first to FIG. 1, a perforating system 100 in accordance with the present invention comprises at least one perforating gun section 101, with two such gun sections 101 being illustrated in FIG. 1. Each of the perforating gun sections 101 comprises a plurality of radially-oriented shaped charges 102, which may, for example, be placed at points along a spiral that extends around the longitudinal axis of perforating gun 101. The shaped charges 102 are detonated using firing head 103 to form perforations in the formation 106. The perforating system may comprise additional joints of tubular members 104, and the number of tubular members 104 that are used in the perforating system will be determined by the depth to which the perforating gun sections 101 are to be lowered in wellbore 105.

Figure 2:
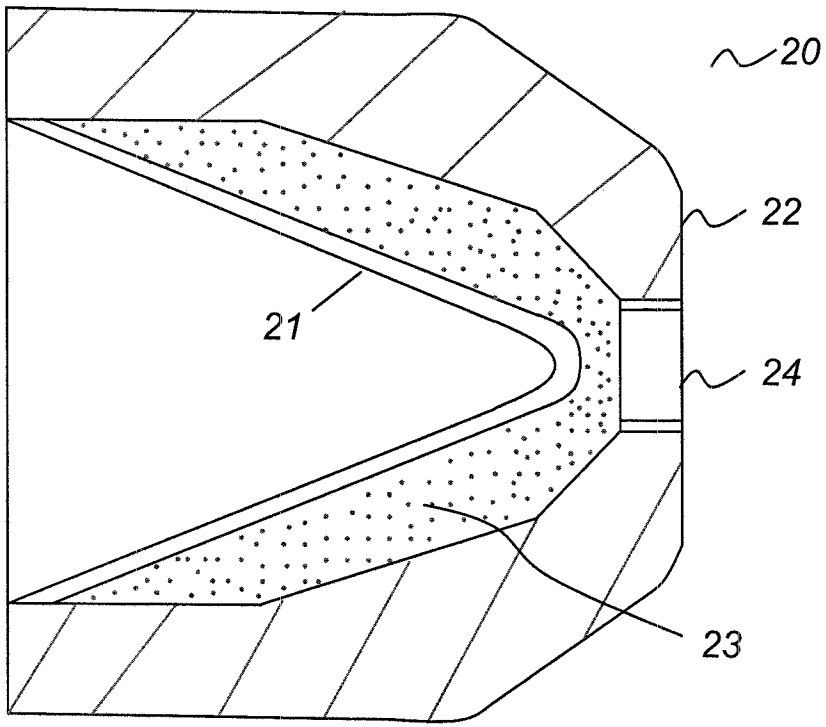
FIG. 2 is a cross-sectional view of a shaped charge that is utilized in the perforating gun system of FIG. 1.

With reference now to FIG. 2, each of the shaped charges 20 used in the perforating gun system 100 of FIG. 1 includes a metal liner 21, a metal case 22 and a main body of high explosive material 23 disposed between the metal liner 21 and the metal case 22. The apex 24 of each shaped charge 20 is adapted to receive a detonation signal from firing head 103 to detonate the shaped charge 20.

Figure 3:
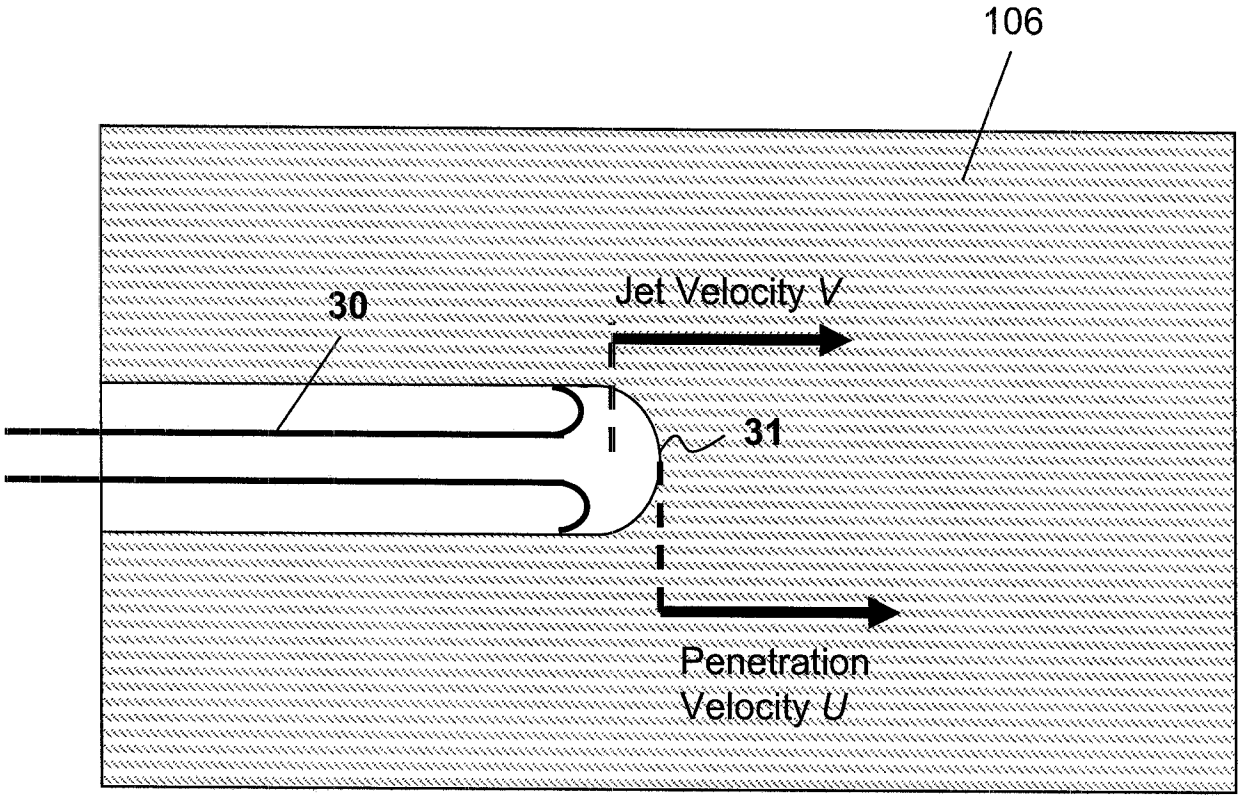
FIG. 3 is a pictorial drawing which illustrates a jet that has been produced by a shaped charge as illustrated in FIG. 2 where the jet is in the process of penetrating the target material.

With reference to FIGS. 2 and 3, when the shaped charge 20 is detonated, it produces a jet 30. Jet 30 first penetrates the casing and then enters the formation material 106, which is the target material. As noted above the jet-target interface 31 will advance at a penetration velocity U according to the formula:

$$u/(v-u)=\mathrm{sqrt}(\rho_j/\rho_t)$$

where V is the velocity of the jet, $\rho_j$ is the jet density and $\rho_t$ is the target density.

Figure 4:
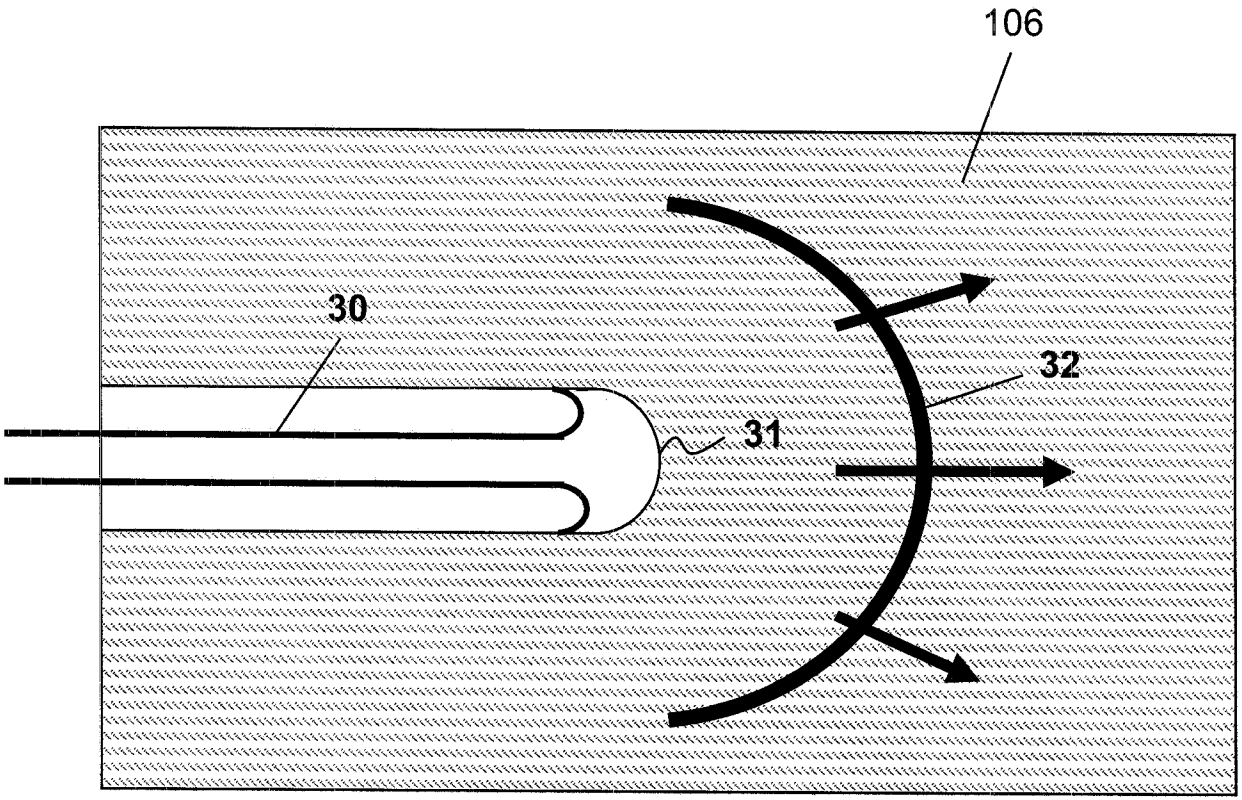
FIG. 4 is a pictorial drawing which illustrates a jet whose penetration velocity is below the acoustic velocity of the formation material and from which the shock wave has become detached.

With reference to FIG. 4, it is well known that a shock wave can precede the advancing jet-target interface 31. It is believed that any discontinuities (fractures, laminations, etc.) within the formation 106 can affect the passing shock wave 32. Specifically if the discontinuity exhibits an impedance mismatch (acoustic impedance=density*acoustic velocity), this would cause some portion of the incoming shock to be reflected, and some to be transmitted. A compressive shock will always be transmitted beyond the discontinuity, but the reflected shock wave could be either compressive or tensile, depending on whether impedance increases or decreases at the interface. In either case, the reflected wave traveling back may disturb the incoming jet 30.

Figure 5:
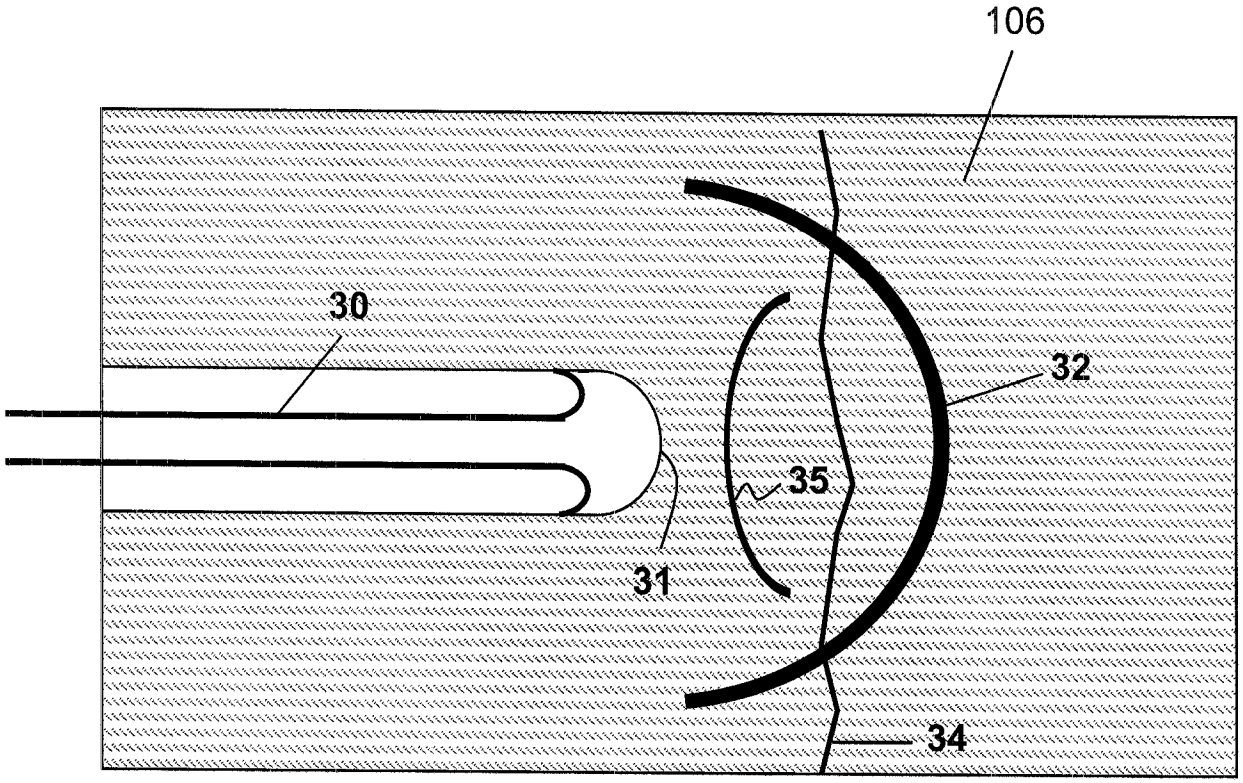
FIG. 5 is a pictorial drawing which illustrates the effects of the detached shock wave of FIG. 4 encountering a preexisting fracture or other discontinuity in the formation material.

With reference to FIG. 4, there is illustrated a situation where shock wave 32 which has become detached from the jet-target interface 31, where the jet-target interface 31 advances at a penetration velocity that is less than the acoustic velocity of formation 106. In FIG. 5, the detached shock wave 32 of FIG. 4 has encountered a fracture 34, which results in a portion 35 of the shock wave 32 being reflected back toward the jet-target interface 31. This reflected portion 35 of shock wave 32 adversely affects the penetration velocity of the jet-target interface 31.

Figure 6:
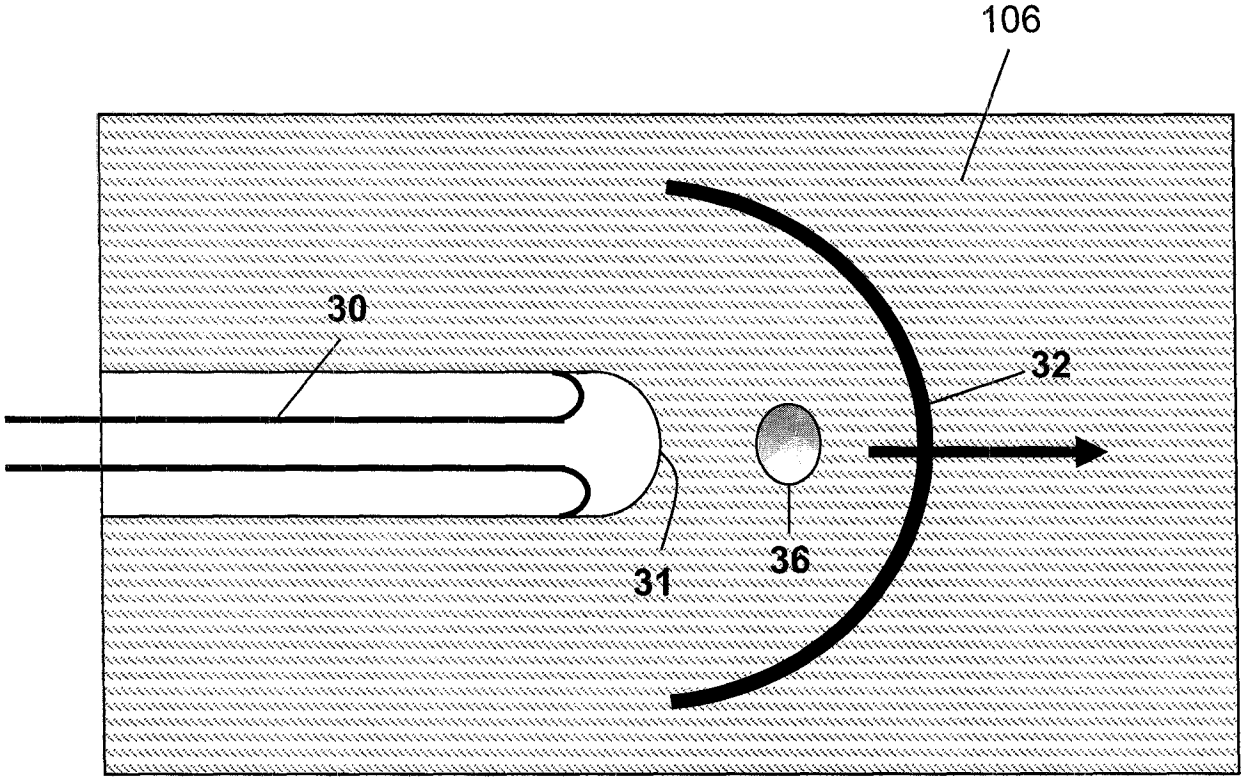
FIG. 6 is pictorial drawing which illustrates a jet whose penetration velocity is below the acoustic velocity of the formation encountering a region in the formation which is in tension, the tension having been created due to the shock wave pulling away from the jet/target interface.
Figure 7:
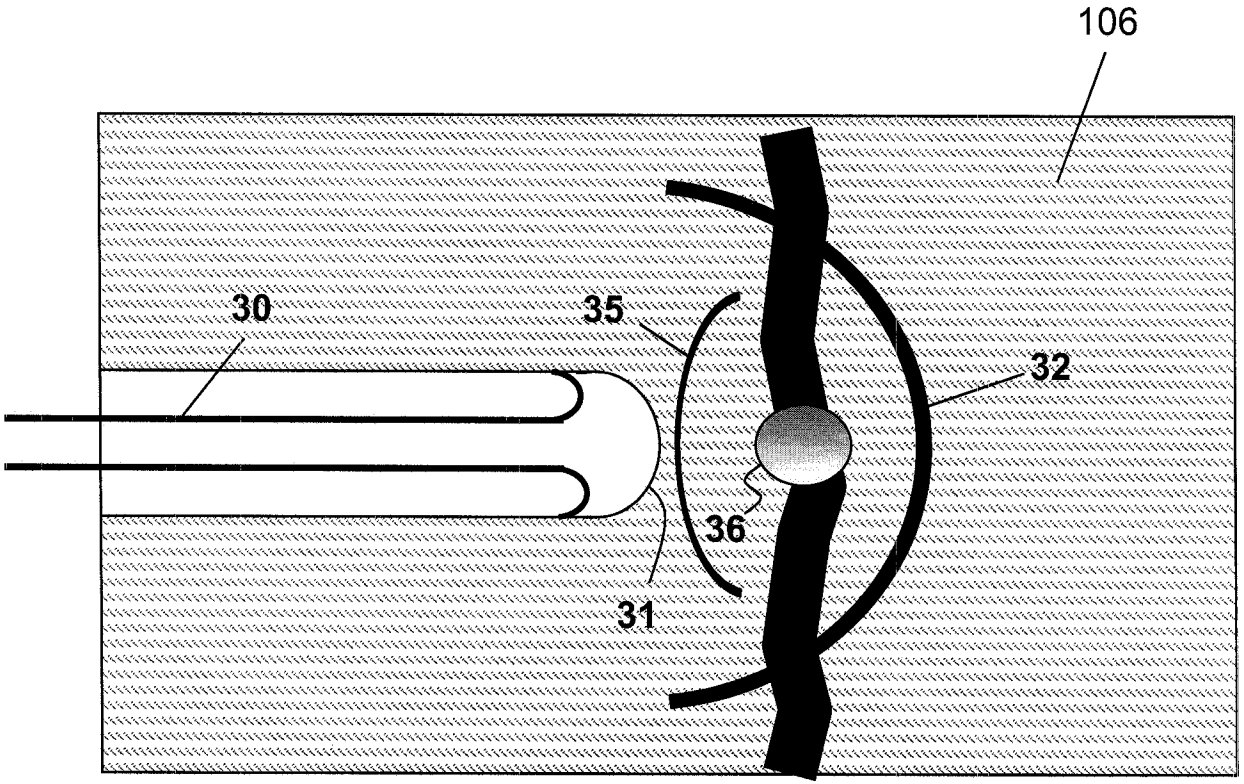
FIG. 7 is a pictorial drawing which illustrates the effects of the situation in FIG. 6.

In addition to shock reflection (which is a consequence of impedance mismatch), it is believed that the compressive shock wave 32 traveling ahead of the jet-target interface 31 may be followed by a region in tension, since the velocity of the detached shock wave is greater than the penetration velocity of the jet-target interface 31. With reference to FIG. 6, such a region in tension 36 is illustrated. If the formation material 106 has a low tensile strength, the region 36 may serve to open existing factures or may create and open new fractures, where such opened existing fractures or new fractures are designated 38 in FIG. 7. This situation produces the same impedance mismatch previously discussed, with the result being that the reflected portion 35 of shock wave 32 adversely affecting the penetration velocity. Since the situation illustrated in FIG. 7 gap-target), total penetration effectiveness (depth) of the perforating jet is reduced.

Figure 8:
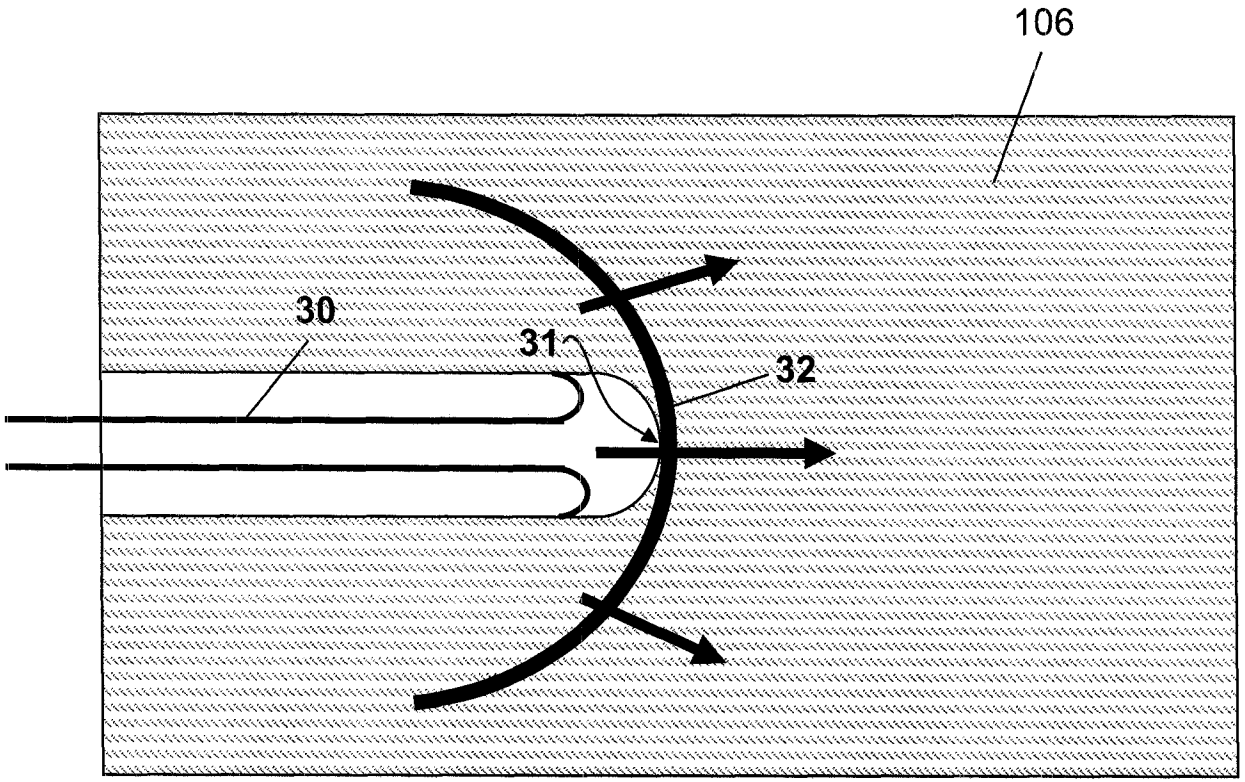
FIG. 8 is a pictorial drawing of a jet whose penetration velocity exceeds the acoustic velocity of the formation material and to which the shock wave remains attached.

Referring to FIG. 8, a charge in accordance with the present invention, is provided for a perforating gun, where the charge, when detonated, produces a jet 30 with a penetration velocity that will always exceed the acoustic velocity of the formation 106. In such a situation, shock wave 32 remains attached (or nearly attached) to the jet-target interface 31, and the perforation is expected to extend deep into the formation 106. Using a charge having the characteristic illustrated in FIG. 8 is especially useful when the formation 106 is a fractured material, such as coal, or has a low tensile strength.

What is claimed is:

1. A method of operating a perforating gun containing a plurality of shaped charges to perforate the formation material proximate a wellbore, which comprises:

obtaining an acoustic velocity of the formation material proximate the wellbore to design the plurality of shaped charges such that they can produce jets having penetration velocities that exceed the acoustic velocity of the formation material proximate the wellbore;

lowering the perforating gun into the wellbore;

detonating the plurality of shaped charges; and producing jets from said shaped charges.

2. The method of claim 1, wherein the formation material proximate the wellbore is coal.

* * * * *